United States Patent [19]

Behnke et al.

[11] Patent Number: 4,768,476

[45] Date of Patent: Sep. 6, 1988

[54] TAPPET WITH CERAMIC CAMFACE

[75] Inventors: Robert C. Behnke, Wheaton; Todd R. Downing, Glen Ellyn, both of Ill.

[73] Assignee: Stanadyne, Inc., Windsor, Conn.

[21] Appl. No.: 236,322

[22] Filed: Feb. 20, 1981

[51] Int. Cl.[4] ..... F01L 1/16

[52] U.S. Cl. ..... 123/90.51; 501/103

[58] Field of Search ..... 123/90.51; 29/156.7 B; 501/103, 104

[56] References Cited

U.S. PATENT DOCUMENTS

| | | | |
|---|---|---|---|
| 2,694,646 | 11/1954 | Wagner et al. | 501/103 |
| 3,526,485 | 9/1970 | Dawihl et al. | 501/103 |
| 4,067,745 | 1/1978 | Garvie et al. | 501/104 |
| 4,183,798 | 1/1980 | Esper et al. | 501/103 |
| 4,279,655 | 7/1981 | Garvie et al. | 501/103 |
| 4,366,785 | 1/1983 | Goloff et al. | 123/90.51 |

FOREIGN PATENT DOCUMENTS

| | | | |
|---|---|---|---|
| 0579515 | 6/1933 | Fed. Rep. of Germany | 123/90.51 |
| 0745701 | 5/1943 | Fed. Rep. of Germany | 123/90.51 |

OTHER PUBLICATIONS

"PSZ", *Nilsen Sintered Products,* Apr. 1980.

"Zirconia", *Nilsen Sintered Products,* Feb. 1979.

Parrish, A. "Mechanical Engineer's Reference Book, 11th ed.", Mass., Butterworth Inc., 1978, pp. 1-74, 1-75, 1-78, 5-163.

*Primary Examiner*—Willis R. Wolfe, Jr.

*Attorney, Agent, or Firm*—Kinzer, Plyer, Dorn, McEachran & Jambor

[57] ABSTRACT

A tappet for an internal combustion engine includes a tappet body having a camface at one end thereof, which camface is positioned for contact with a rotating camshaft. The camface is formed essentially of zirconium oxide.

8 Claims, 1 Drawing Sheet

TAPPET WITH CERAMIC CAMFACE

SUMMARY OF THE INVENTION

The present invention relates to tappets, both hydraulic and mechanical, and in particular to an improved tappet camface having superior stress and wear resistant characteristics which is formed essentially of zirconium oxide.

Another purpose is a tappet camface of the type described which is compatible with both cast iron and steel.

Another purpose is a tappet camface of the type described which will not cause excessive wear on the mating camshaft.

Another purpose is a tappet camface formed of zirconium oxide, which camface will wear compatibly with the camshaft bearing thereagainst.

Another purpose is a tappet construction of the type described having a camface formed of zirconium oxide which has essentially the same coefficient of expansion as the steel material to which it is attached, thereby preventing differential expansion or contraction during engine operation between the camface and its associated tappet body.

Another purpose is a tappet camface of the type described which has superior wear and stress characteristics relative to conventional cast iron tappets.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
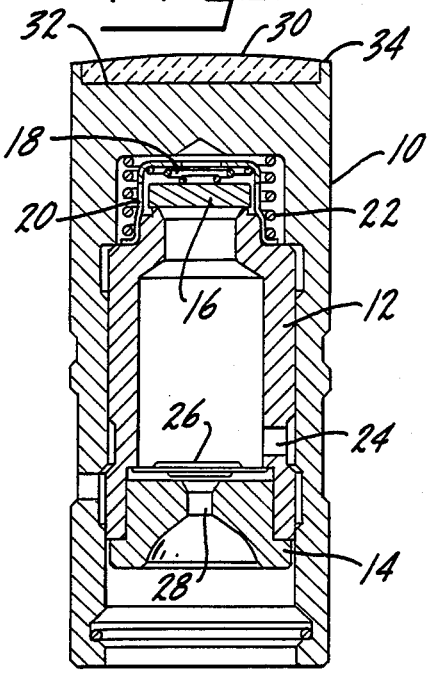
FIG. 1 is an axial section through a hydraulic tappet illustrating the improved camface of the present invention.

Automobile and engine manufacturers are directing research and development efforts toward more efficient, more powerful engines, but yet engines which require no increase in either size or weight. Such design requirements of necessity place greater stress on the valve train components. Specifically, in the case of diesel engines, which are by nature somewhat dirty in terms of the emissions they produce, government regulations have mandated that diesel emissions must be substantially controlled. In order to improve the emission control of diesel engines it is necessary to change the cam profile so as to provide different valve operating sequences. This again increases the stress on the valve train components and specifically the camface of the mechanical or hydraulic tappets associated therein.

The result of the design direction of internal combustion engines as discussed above, which has provided greater stress and greater wear on the camface of hydraulic and mechanical tappets, is that the traditional materials used for the camface of such tappets no longer will satisfactorily provide the necessary wear and stress characteristics. Accordingly, the emphasis has been on new and improved materials to utilize at the camface of hydraulic and mechanical tappets, which materials will be sufficiently wear and stress resistant for engines of the type described.

There has been a shift toward the utilization of tappets having a tungsten carbide wear surface. This type of material, however, has not been wholly satisfactory, principally because the thin tungsten carbide wear element, which will be bonded to one end of the tappet body, is susceptible to cracking due to brittleness and, if any portion of the tungsten carbide were to break off from the tappet, this element, which would essentially be a cutting device, would then be loose within the engine which would, as practice has shown, destroy the engine. A further disadvantage of the tungsten carbide wear surfaces for tappets is that such wear surfaces, while being compatible with steel, are not compatible with cast iron, which is the more conventional material used in the manufacture of camshafts.

The present invention utilizes zirconium oxide, which is commonly called zirconia and which is essentially zirconium with minor amounts of magnesium oxide. The product is specifically designated as a partially stabilized zirconia and is of a type as manufactured by Nilsen Sintered Products, A Division of the Nilsen Group of Australia.

A material such as tungsten carbide, and zirconia or zirconium oxide which is considered a ceramic, are inherently brittle materials. This is one of the reasons why tungsten carbide has been unsatisfactory. However, it has been determined that zirconia is not as brittle as tungsten carbide and is a satisfactory material for the described use even when it is formed into a wafer or disc. The wear and stress-resistant properties of zirconia are of such great advantage that the material has been found to be highly satisfactory for use as the camface of mechanical and hydraulic tappets. Zirconia has been found to have greater wear-resistant characteristics than the most sophisticated and refined chilled iron camface tappet, for example such as shown in U.S. Pat. No. 4,153,017. Further zirconia has been found to have superior wear and stress resistant characteristics when compared with tungsten carbide.

There are several very specific advantages of zirconia. It has compatibility with both cast iron and steel camshafts, which is an unusual characteristic, as normally a material will only be compatible with one or the other. Thus, zirconia has wide use as a tappet camface and can be used with either cast iron or steel camshafts, although cast iron camshafts are more conventionally found in internal combustion engines. In this same area the wear on the zirconia camface and on a cast iron camshaft has been found to be essentially the same, a distinct advantage in valve train components. Further, zirconia has essentially the same coefficient of expansion as steel which is conventionally the material used to form the body of the tappet. Thus, there will be no differential expansion or contraction of the camface relative to the steel tappet body during operation of the engine.

Figure 2:
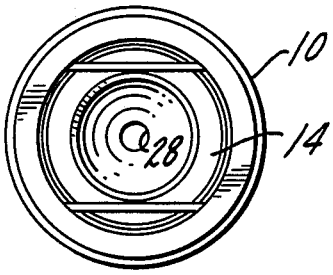
FIG. 2 is an end view of the tappet of FIG. 1.

Turning to FIGS. 1 and 2, a conventional hydraulic tappet, for example as described in U.S. Pat. No. 3,683,876, is illustrated. The designated patent refers to a powdered metal barrel and the barrel of the present application will be steel. Nevertheless, the overall construction is the same. The tappet body is indicated at 10 and a hollow plunger 12 is reciprocally mounted within the tappet body. A plunger cap 14 may close one end of the plunger and a valve 16 closes the opposite end. A small spring 18, held by a retainer 20, urges valve 16 against the mating plunger seat. A larger coil spring 22 is positioned to react oppositely to the plunger and tappet body, as is conventional. An oil passage 24 opens into the chamber defined by the plunger and there may be a metering valve 26 closing a small orifice or passage 28 in the plunger cap 14.

The body camface as shown in FIG. 1, which may have a very slight crown is formed by a disc 30 consisting essentially of zirconia and is seated within a recess 32 in the tappet body. The recess may be defined by an annular shoulder 34 and the disc may be attached to the body 10 within the recess by a number of different processes. For example, there may be a bonding by the use of one of several epoxies and a material manufactured by the H. B. Fuller Company, designated FE-185 and called "Resi-Weld", has been found to be satisfactory. Other types of bonding agents may be utilized as may an interference of shrink fit. Similarly, there may be a metalized coating and subsequently a heating step to attach the zirconium disc to the tappet body. The specific type of bonding and/or attaching means is not critical providing that the bond is sufficient to withstand normal engine operation.

Figure 3:
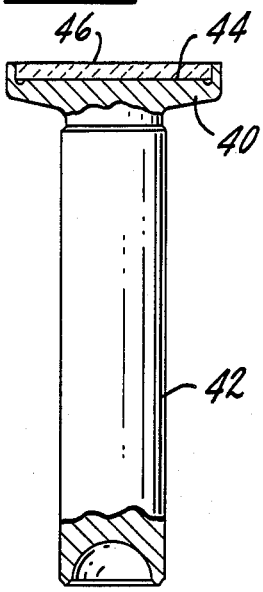
FIG. 3 is a partial axial section through a modified form of tappet illustrating the improved camface of the present invention.
Figure 4:
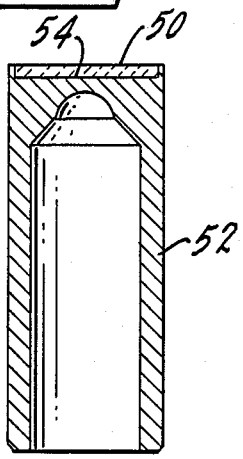
FIG. 4 is an axial section through a further form of tappet.

FIGS. 3–7 illustrate variant forms of tappet construction and the utilization of different configurations of zirconia discs therewith. In FIG. 3 there is what is known as a mushroom-type tappet in which a camface 40 is enlarged over the diameter of tappet body 42. There is a recess 44 in which is positioned a zirconia disc 46, similar to the disc of FIGS. 1 and 2.

In FIG. 4 a tappet body 52 again has a closed end as in the FIGS. 1, 2 and 3 constructions, and zirconia disc 50 is positioned within a recess 54 and bonded or otherwise attached therein. Body 52 is hollow, whereas the body 42 of FIG. 3 is solid.

Figure 5:
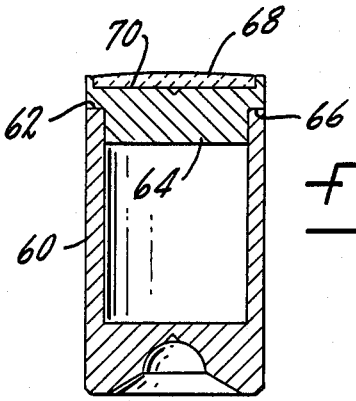
FIG. 5 is an axial section through yet an additional form of tappet construction.
Figure 6:
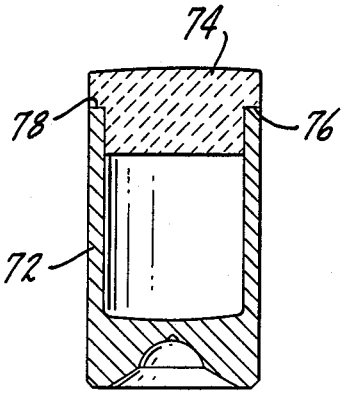
FIG. 6 is an axial section through a further modified form of tappet construction.

In FIG. 5 tappet body 60 has an open end defining a shoulder 62. A steel insert 64 having a step configuration as illustrated at 66, is positioned within the open end of the body with the step mating with shoulder 62 to form a closure for the tappet body open end. A disc of zirconia 68 is seated within a recess 70 in insert 64, with the disc being similar in construction to that illustrated in FIGS. 1–3.

In FIG. 6 a tappet body 72 again is of an open end construction and in this case the entire closure for the open end is formed by a zirconia insert or disc 74. There is an annular recess or groove 76 in the zirconia insert, which groove or recess will cooperate with a shoulder 78 on tappet body 72 to mount the zirconia camface.

Figure 7:
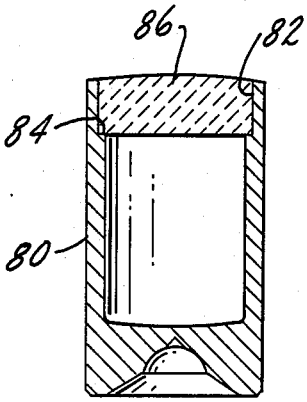
FIG. 7 is an axial section through yet an additional modified form of tappet construction.

In the FIG. 7 construction a tappet body 80 has an open end and an annular recess 82 terminating in a shoulder 84. A zirconia insert 86 is positioned within the confines of groove 82 and is seated upon shoulder 84.

Whereas the preferred form of the invention has been shown and described herein, it should be realized that there may be many modifications, substitutions and alterations thereto.

The embodiments of the invention in which an exclusive property or privilege is claimed are defined as follows:

1. In a tappet for an internal combustion engine, a tappet body, a disc attached to said tappet body at one end thereof, said disc being formed essentially of zirconium oxide and providing the tappet camface which is positioned for contact with a rotating camshaft, said zirconium oxide disc having wear characteristics compatible with cast iron and steel and having essentially the same coefficient of thermal expansion as the material of the tappet body.

2. The tappet of claim 1 further characterized in that said tappet body has a closed end, with said disc being attached to said closed end.

3. The tappet of claim 2 further characterized in that said closed tappet body end includes a recess, with said disc being positioned within said recess.

4. The tappet of claim 1 further characterized in that said tappet body has an open end, with said disc forming a closure for said open end.

5. The tappet of claim 4 further characterized in that said tappet body open end includes an annular groove and a shoulder at one end of said groove, said disc being positioned within said groove and against said shoulder.

6. The tappet of claim 4 further characterized in that said disc includes a portion of reduced diameter and a shoulder adjacent thereto, with said portion of reduced diameter being positioned within said tappet body and with said shoulder being positioned against the end of said tappet body.

7. The tappet of claim 4 further characterized by and including a non-zirconium oxide insert extending partially within said tappet body and forming a support for said zirconium oxide disc.

8. The tappet of claim 7 further characterized in that said non-zirconium oxide insert is formed of metal and has a recess at one end thereof, with said disc being positioned within said recess.

* * * * *